United States Patent [19]

Blanton, Jr. et al.

[11] Patent Number: 4,992,161

[45] Date of Patent: Feb. 12, 1991

[54] CHROMIUM/TIN MIXTURE AS SULFUR DIOXIDE OXIDATION PROMOTER FOR FCC UNITS

[75] Inventors: William A. Blanton, Jr., Woodacre; Alan W. Klaassen, Kensington, both of Calif.

[73] Assignee: Chevron Research Company, San Francisco, Calif.

[21] Appl. No.: 197,378

[22] Filed: May 23, 1988

Related U.S. Application Data

[63] Continuation-in-part of Ser. No. 811,867, Dec. 20, 1985, abandoned, which is a continuation of Ser. No. 447,334, Dec. 6, 1982, abandoned.

[51] Int. Cl.[5] ..... C10G 11/05

[52] U.S. Cl. ..... 208/121; 208/120; 208/149; 423/244

[58] Field of Search ..... 208/113, 120, 164, 149, 208/121; 423/244 R

[56] References Cited

U.S. PATENT DOCUMENTS

| | | | |
|---|---|---|---|
| 1,115,251 | 9/1978 | Planders et al. | 208/120 |
| 3,696,025 | 10/1972 | Chessmole et al. | 208/113 |
| 4,040,945 | 8/1977 | McKinney et al. | 208/113 |
| 4,141,959 | 2/1979 | Kato et al. | 252/411 |
| 4,153,535 | 5/1979 | Vasalos et al. | 208/120 |
| 4,300,997 | 11/1981 | Megueian et al. | 208/120 |

*Primary Examiner*—Anthony McFarlane

[57] ABSTRACT

Controlling sulfur oxide emissions from FCC regenerator flue gas by mixing a sulfur sorbent in the circulating inventory and having present in the regeneration zone a chromium/tin sulfur dioxide oxidation promoter.

2 Claims, No Drawings

CHROMIUM/TIN MIXTURE AS SULFUR DIOXIDE OXIDATION PROMOTER FOR FCC UNITS

CROSS-REFERENCE TO RELATED APPLICATIONS

This application is a continuation-in-part application of U.S. Ser. No. 811,867, filed Dec. 20, 1985, now abandoned, which was a continuation of U.S. Ser. No. 447,334, filed Dec. 6, 1982, now abandoned.

BACKGROUND OF THE INVENTION

Fluid catalytic cracking involves the catalytic conversion of heavy hydrocarbons to lighter petroleum stocks. A typical fluid catalytic cracking (FCC) unit has a hydrocarbon cracking zone and a catalyst regeneration zone. A particulate catalyst, generally containing a zeolite, is cycled between the cracking zone where the hydrocarbon feedstock is cracked and a regeneration zone where the coke formed on the catalyst in the cracking zone is burned off. The combustion gases formed in the regeneration zone often contain unacceptable amounts of the oxides of sulfur, i.e., sulfur dioxide and sulfur trioxide.

The sulfur oxides may be controlled by including a metal or metal compound such as alumina, in the circulating inventory of the FCC unit, i.e., in admixture with the cracking catalyst. See U.S. Pat. No. 4,071,436. The metal or metal compound referred to herein as a sulfur sorbent readily forms a stable association in the oxidative environment of the regenerator with sulfur trioxide removed from the flue gas. In the reducing environment of the cracking zone the sulfur is released principally as hydrogen sulfide which is readily scrubbed from the effluent gases by known technology. Since the sulfur sorbent is most effective at removing sulfur trioxide from the regenerator flue gas, it is advantageous to also provide a sulfur dioxide oxidation promoter in the regenerator to convert the sulfur dioxide to sulfur trioxide.

One of the most effective sulfur dioxide oxidation promoters is platinum. Since platinum is relatively expensive, it would be desirable to use a less expensive promoter that exhibits equally good oxidation activity. Chromium has been used as an oxidation catalyst in some processes, but under catalytic cracking conditions it has been observed to have high mobility which leads to a loss of activity over time.

SUMMARY OF THE INVENTION

It has been found that a mixture of chromium and tin is highly effective in promoting the oxidation of sulfur dioxide to sulfur trioxide. Therefore, the present invention is directed to an improved fluid catalytic cracking process wherein a circulating inventory including a particulate cracking catalyst is cycled between a hydrocarbon cracking zone and a catalyst regeneration zone and wherein the sulfur content of gases leaving the regeneration zone is controlled by including in the circulating inventory a sulfur oxide sorbent, the improvement comprising having present in the regeneration zone a sulfur dioxide oxidation promoter containing an intimate association of chromium and tin or of the compounds thereof.

The present invention is also directed to a composition of matter useful for cracking a sulfur-containing hydrocarbon in the absence of added hydrogen which comprises:

(a) a particulate cracking catalyst for cracking a hydrocarbon in the absence of hydrogen;

(b) a first particulate solid other than said cracking catalyst comprising a sulfur sorbent capable of sorbing sulfur trioxide; and (c) a second particulate solid other than said particulate cracking catalyst, said second particulate solid containing an intimate association of chromium and tin or of the compounds thereof.

The chromium/tin mixture when used as an $SO_2$ catalyst has been found to retain the good oxidation promoting characteristics of chromium without its undesirable loss of activity due to mobility under catalytic cracking conditions.

The phrase "circulating inventory" refers to the particulate solids which are cycled between the cracking zone and regeneration zone. Thus, the phrase includes, but is not necessarily limited to, the cracking catalyst, the particulate sulfur sorbent, and the promoter particles.

As used herein, the phrase "sulfur sorbent" refers to a material capable of forming a stable association with sulfur trioxide in the regenerator of an FCC unit and capable of dissociation in the hydrocarbon cracking zone. This association may be formed by absorption, adsorption, or by chemical reaction. Such sulfur sorbents include alumina and magnesia or combinations thereof. Particularly preferred as a sulfur sorbent is "reactive alumina" which may be described as alumina having a surface area of at least 50 $m^2/g$, e.g., gamma- or eta-alumina. Suitable reactive alumina is not in intimate combination with more than about 40% silica, and preferably is substantially free from admixture with silica. A full description of reactive alumina may be found in U.S. Pat. No. 4,071,436, the text of which is herein incorporated by reference.

DETAILED DESCRIPTION OF THE INVENTION

The present invention is directed to a sulfur dioxide oxidation promoter which is comparable in activity to platinum but is significantly less expensive. As noted above, the promoter comprises an intimate association of chromium and tin or of the compounds of chromium and tin. Generally, the metals will be present as their oxides, although other compounds of the metals may be used to prepare the promoter.

Both chromium and tin form various oxides, and in the environment of the FCC unit, it is believed that the various oxides of the metals will readily convert from one to another. Therefore, as used herein, the term "chromium oxide" refers to any and all of several possible oxides such as CrO, $Cr_2O_3$, and $CrO_3$. In the case of tin, the term "tin oxide" shall refer to both SnO and $SnO_2$. In addition to the oxides of chromium and tin, other compounds containing the metals, such as the chloride, may be used to prepare the promoter. However, it is believed that the oxides of the metals are the active form, and such compounds are probably converted to the oxide in situ. Likewise the pure metal may be deposited on the promoter particles, but in the environment of the regenerator the metals are probably present in the form of their corresponding oxides.

The metals need not be placed on a support prior to mixing them into the circulating inventory, however, the invention is generally practiced by placing a mixture of chromium and tin, or a mixture of the compounds of said metals, on a solid support. Preferably, the support is a particulate solid which may be physically admixed and circulated with the cracking catalyst and sulfur sorbent. Such materials include porous inorganic oxides, such as alumina and silica, or mixtures of two or more inorganic oxides, such as silica/alumina, natural and synthetic clays and the like, crystalline aluminosilicate zeolites, etc.

It is generally undesirable to include the metals promoter on the same particle as the sulfur sorbent. The metals promoter tends to "cover" the surface of the sorbent and reduce its sorption efficiency. Also, the metals tend to affect oxygen consumption at the particle surface, creating an oxygen deficiency which also works against effective adsorption of the sulfur oxides. The support for the promoter, therefore, is not intended and does not generally function as a sulfur sorbent, and the sorbent is a separate and discrete component of the system.

Particularly preferred as a support for the chromium/tin mixture is titanium dioxide. It has been found that the steam stability of chromium/tin mixtures is improved markedly when a titanium dioxide support is used in preference to a more conventional support such as alumina. In tests intended to be indicative of the conditions present in the hydrothermal environments of the FCC, it was found that chromium/tin mixtures in titanium dioxide were more stable than chromium/tin mixtures in alumina or than commercial platinum promoters.

In placing the metals on a support, they may be added in any suitable manner as by impregnation or ion exchange. The metals may also be added to a precursor of a selected solid support as by coprecipitation from an aqueous solution with an inorganic oxide precursor. In the case of a particulate promoter-support, the particulate solid can be formed into particles of a size suitable for use in an FCC system by conventional means, such as by spray-drying, crushing of large particles to the desired size, etc.

When incorporating the promoter into the circulating inventory of the FCC unit, sufficient promoter should be present to promote the oxidation of sulfur dioxide to sulfur trioxide. In general, the total metal content of the promoter will constitute from about 0.1 to about 20% by weight of the promoter-support association and from about 10 to about 10,000 parts per million by weight of the total circulating inventory. The relative weight ratio of chromium to tin will generally fall within the range of from about 1:3 to about 3:1.

The sulfur sorbent included in the circulating inventory is preferably reactive alumina. However, other sulfur sorbents have been described and could be used with the present invention. In general, a suitable sulfur sorbent should be capable of sorbing at least about 50 weight percent of the sulfur oxides present in the regeneration zone. In the case of reactive alumina, the particles of sulfur sorbent will usually contain at least 60% by weight of alumina. The alumina will have a surface area of at least 50 square meters per gram and contain from about 0.1 to 100% by weight reactive alumina. The sulfur sorbent will usually be in sufficient amount with the catalyst to provide from about 0.1 to about 25% by weight of alumina with respect to the total circulating inventory. Generally, the sulfur sorbent is included as a particulate solid physically admixed with the catalyst particles and the promoter particles. However, the sulfur sorbent may also be present on the catalyst particles. See, for example, U.S. Pat. No. 4,115,249.

The catalyst employed in cracking the hydrocarbon feedstock may be a conventional catalyst suitable for use in an FCC system. Such catalysts normally contain silica and/or alumina. Other refractory metal oxides, such as magnesia and zirconia, have been suggested and could be employed if desired. Various types of naturally occurring and synthetic aluminosilicate molecular sieves are usually incorporated into the cracking catalyst. The choice of catalyst is not critical to the invention.

However, it is usually desirable to restrict the silica in the matrix to less than 40 weight percent. See U.S. Pat. No. 4,259,176. It is anticipated that the selection of catalyst will depend on the feedstock to be cracked and the mode of operation rather than on the oxidation promoter selected. Thus, catalyst selection is well within the knowledge of one skilled in the art and should require no further explanation here.

Various other types of materials may be included in the circulating inventory of the FCC unit, provided they do not interfere substantially with the activity of the metal promoters. Additional carbon monoxide oxidation promoters can be added such as copper. Sodium has also been employed in association with alumina in the sulfur sorbent. Moderate amounts of such materials are not detrimental to the operation of the invention.

At the promoter concentrations employed for oxidizing sulfur dioxide to sulfur trioxide, the chromium/tin association will also act as a carbon monoxide oxidation promoter. Therefore, it is usually unnecessary to include an additional carbon monoxide oxidation promoter in the circulating inventory.

What is claimed is:

1. A fluid catalytic cracking process wherein a circulating inventory of particles is cycled between a hydrocarbon cracking zone and a catalytic regeneration zone, said inventory comprising the admixture of three separate and discrete components, (1) a particulate cracking catalyst comprising zeolite for cracking hydrocarbon in the absence of hydrogen, (2) a particulate sulfur oxide sorbent comprising reactive alumina capable of sorbing sulfur trioxide, and (3) a particulate sulfur dioxide oxidation promoter containing an intimate association of chromium and tin or compounds thereof on a titanium dioxide support.

2. The process of claim 1 wherein the chromium to tin ratio in said promoter is in the range of from about 3:1 to about 1:3 and the total content of said promoter metal in the circulating inventory is in the range of from about 10 to about 10,000 ppm by weight.

* * * * *